United States Patent [19]

Anderson et al.

[11] 4,062,394

[45] Dec. 13, 1977

[54] SHUTTER DEVICE

[76] Inventors: Leif P. R. Anderson, Bogatan 39 A, S-412 72 Goteborg; Lars Gunnar Serneblad, Nordostpassagen 22, S-413 11 Goteborg, both of Sweden

[21] Appl. No.: 710,675

[22] Filed: Aug. 2, 1976

[30] Foreign Application Priority Data

Feb. 4, 1975 Sweden ..... 7501187

[51] Int. Cl.[2] ..... E06B 9/30

[52] U.S. Cl. ..... 160/172

[58] Field of Search ..... 160/172, 176, 202

[56] References Cited

U.S. PATENT DOCUMENTS

| | | | |
|---|---|---|---|
| 1,842,589 | 1/1932 | Drysdale | 160/202 |
| 2,583,361 | 1/1952 | Duffin | 160/172 |
| 3,130,775 | 4/1964 | Walker | 160/172 |
| 3,190,346 | 6/1965 | Arena et al. | 160/172 |
| 3,520,346 | 7/1970 | Green | 160/172 |

*Primary Examiner*—Peter M. Caun

[57] ABSTRACT

The present invention relates to a shutter device comprising a number of shielding slats and operating means, by means of which the shielding slats are displaceable from a position substantially removed from the shielding surface to individual positions distributed over said surface, and pivotable round their longitudinal axis for setting in different angular positions to provide the desired shielding of a surface. The device further comprises two guide rails carrying a number of runner units provided in pairwise arrangement in order to support the two ends of the respective shielding slat in such a manner, that the shielding slats are pivotable relative to the runner units and retainable in said individual positions distributed over the shielding surface. According to the invention the device is provided with retaining means comprising supporting organs on each runner unit and stops provided in each one of the guide rails which stops are so situated in the transverse direction of the respective guide rail that each one of them is in the path of movement of one of the individually placed supporting organs of the runner units and so situated in the longitudinal direction of the respective guide rail that each slat is in its predetermined individual position when the respective supporting organ is resting on the corresponding stop.

1 Claim, 9 Drawing Figures

SHUTTER DEVICE

Figure 1:
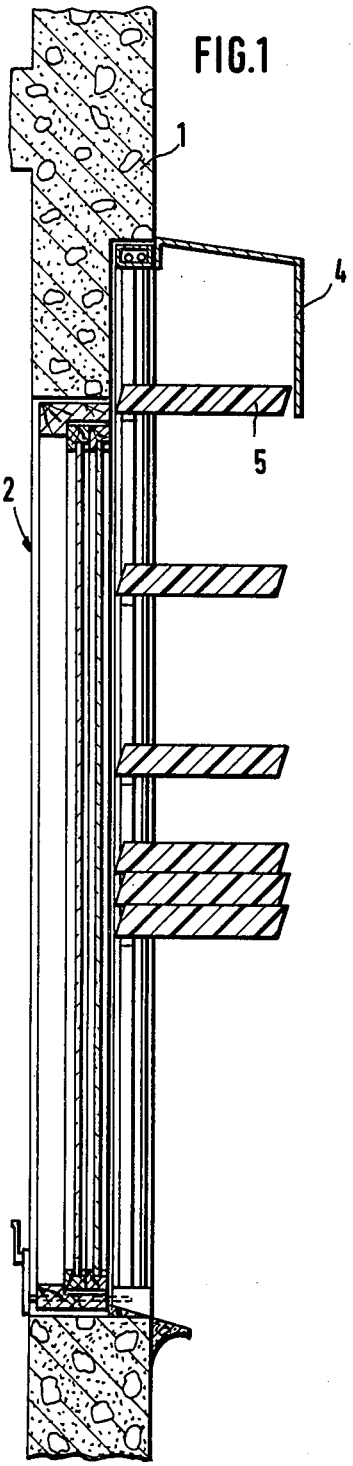

The present invention relates to a device for adjustable shielding of a surface, as a window or similar, which device comprises a number of shielding slats and operating means, by means of which the shielding slats are displaceable from a position substantially removed from the shielding surface to individual positions distributed over said surface, and pivotable round their longitudinal axis for setting in different angular positions to provide the disired shielding of the surface in question, and further two guide rails, which extend in the direction of displacement of the shielding slats on each side of these, and carrying a number of runner units provided in pairwise arrangement in order to support the two ends of the respective shielding slat in such a manner that the shielding slats are pivotable relative to the runner units, the guide rails comprising means adapted to retain the shielding slats in said individual positions distributed over the shielding surface.

There is a more and more increasing need of shielding living quarters as well as places of public resort from a noisy environment, such need especially manifesting itself at nights. On the other hand there is increasing need of a better utilization of the thermal energy in heated rooms where heat losses through surfaces of glass as windows etc. make up a substantial part of the total heat losses As a basis for the present invention there is the desire to provide a shielding means in the form of a shutter device with considerable sound and heat insulating properties, by means of which device the shielding degree can be adjusted to the present need.

There is no complete solution of the problem in question known in the prior art, which may be due to the difficulties of a technical nature, which have to be overcome in this connection. A great part of the difficulties can be referred to the practical necessity of mounting a shutter device of the characteristics mentioned above at the outside of the surface to be shielded, which results in that the device will be exposed to the inclemency of the weather and will have to be designed in order to meet the requirements of resistance against corrosion etc. Moreover, heavy demands are made upon the stability and reliability of the device because of the applications mentioned above.

It is an object of the present invention to provide a device, which fulfills the above mentioned requirements.

The object of the invention is obtained by means of a shutter device, in which said retaining means comprising supporting organs substantially provided on each runner unit and supporting organs belonging to said organs and preferably provided in each one of the guide rails, which organs are so situated in the transverse direction of the respective guide rail that each one of them is in the path of movement of the indivudually placed supporting organ belonging thereto and so situated in the longitudinal direction of the respective guide rail that each slat is in its predetermined indiviual position when the respective supporting organ is resting thereon.

In abstract form the fundamental idea of the invention can be expressed as providing a design, which firmly retains the slats of the shutter device in their set positions, with the movable parts necessary for change of position of the slats being well protected against weather influences.

Figure 2:
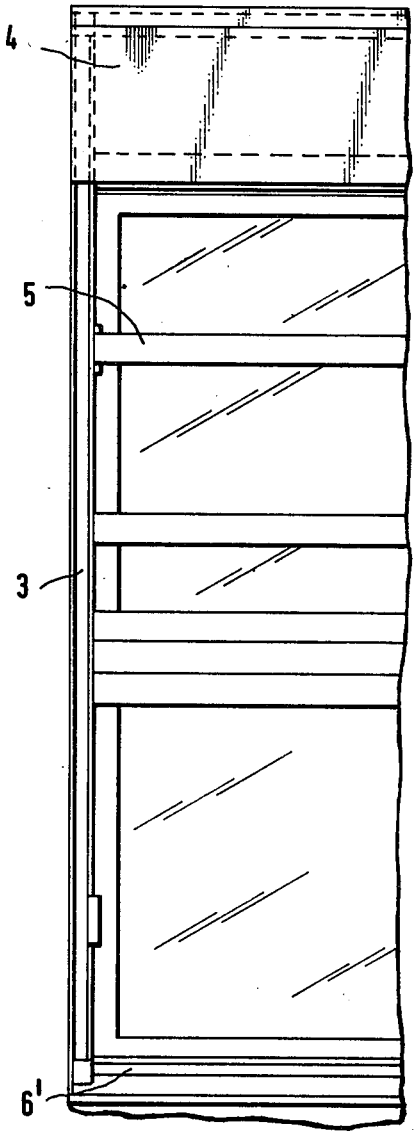
Figure 3:
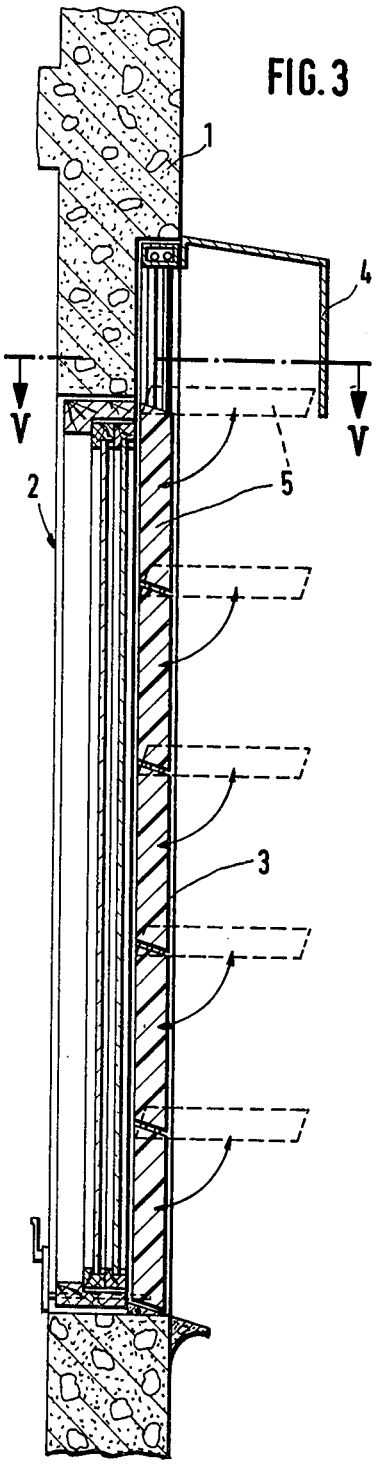
Figure 4:
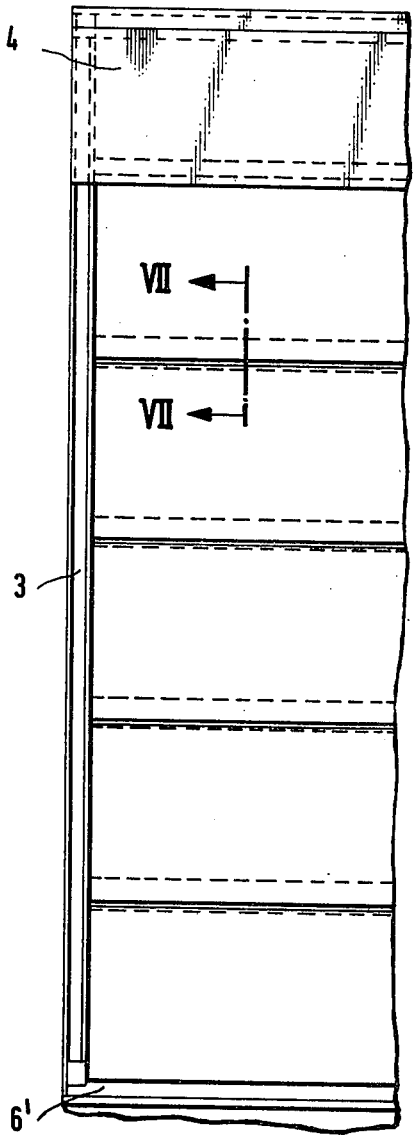
Figure 5:
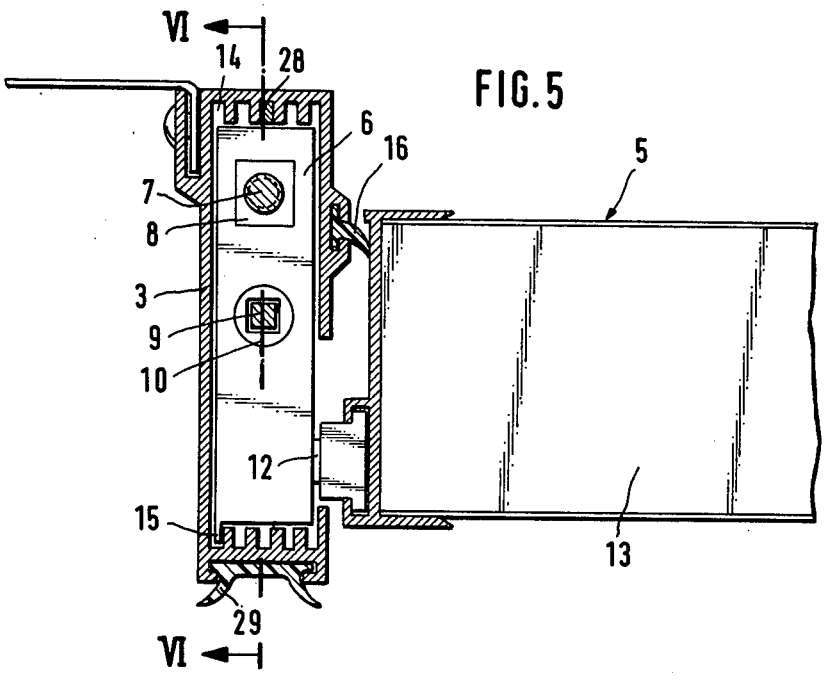
Figure 6:
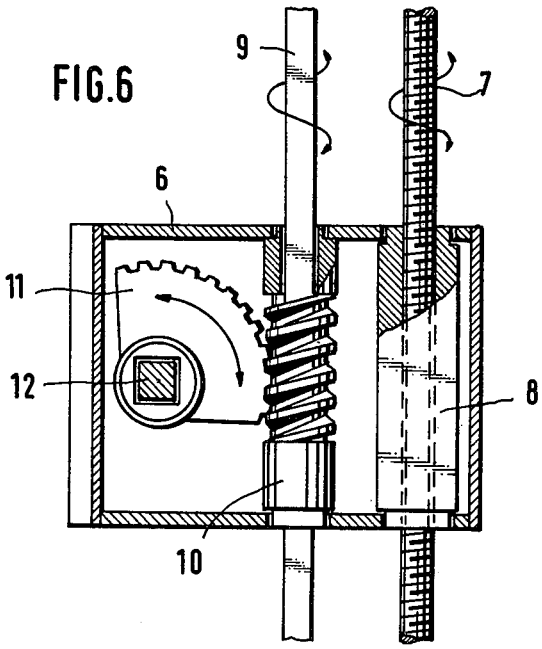
Figure 7:
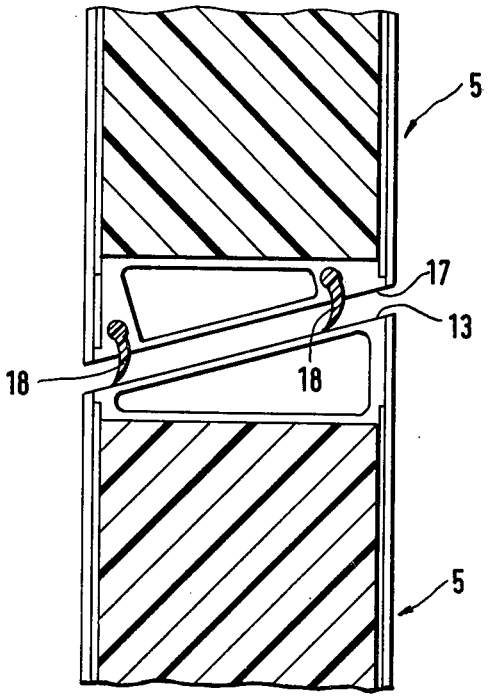
Figure 8:
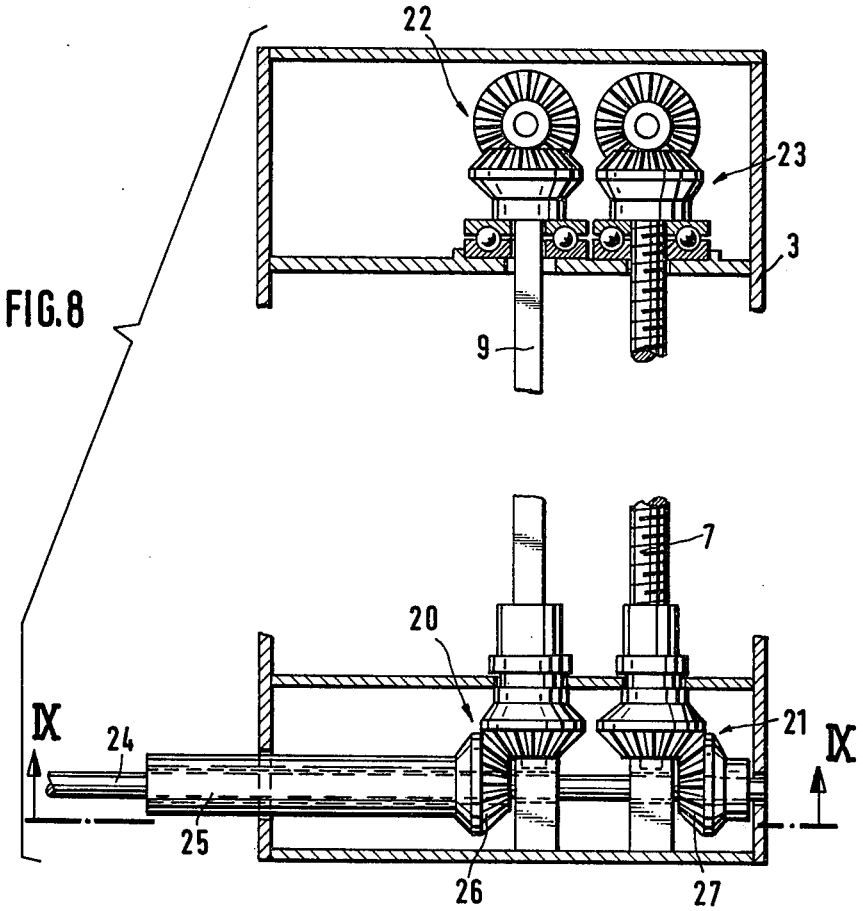
Figure 9:
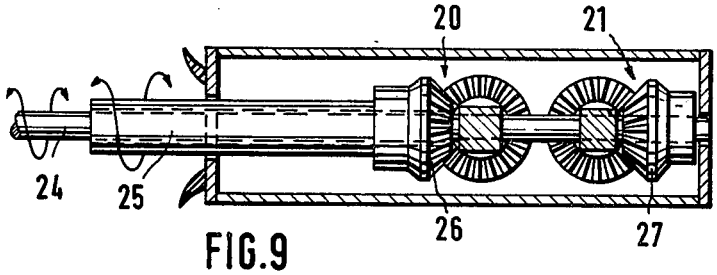

The invention will now be described more in detail by means of an example of embodiment of the same, references being made to the accompanying drawings in which the FIGS. 1 and 2 illustrate the shutter device according to the invention, the slats being under displacement, FIGS. 3 and 4 illustrate the shutter device in position of use, the shielding slats in completely shielding position, being indicated with continuous lines and in open position with broken lines, FIG. 5 is a cross--sectional view along the line V—V in FIG. 3 of the position of a runner unit in a guide rail and its connection with one of the shielding slats, FIG. 6 is a cross-sectional view along the line VI—VI in FIG. 5 in a plane at right angle to the cross-section illustrated in FIG. 5 showing the design of one of the runner units, FIG. 7 in a partial view on an enlarged scale of the device according to FIG. 4 and along line VII—VII in FIG.4 shows longitudinal edge portions facing each other of two juxtapositioned shielding slats in shielding position, FIG. 8 is a partly broken view of a longitudinal vertical cross-section through one of the guide rails and showing rigidly mounted operating means, and FIG. 9 is a view of a cross-section along the line IX—IX in FIG. 8.

As is evident from FIGS. 1 - 4 the shutter device according to the present invention in the illustrated embodiment is foremost intended to be mounted at the outside of surfaces of glass in a building facade 1, by means of example a window 2. The shutter device according to the invention substantially comprises two vertical guide rails 3 oppositely disclosed with respect to each other, in a parallell arrangement said guide rails at the top connected by means of a transverse collecting box 4 for the shielding slats 5 intended for shielding the window, The slats extend between the two guide rails 3. Moreover, the guide rails 3 at their bottom portion are connected by means of a transverse profile 6' which together with the guide rails 3 and the collecting box 4 form a rigid frame.

The shielding slats 5 can on the one hand be vertically displaced between the out-of-sight position in the collecting box 4, in which position the window 2 thus is free from any shielding, and different individual height positions for each shielding slat, and on the other hand be pivotable round their longitudinal axis between a vertical position in which a maximal shielding effect is obtained, and a horisontal position, in which the shutter is maximally open. The displacing movement of the shielding slats 5 is provided by means of for each slat two runner units 6 located at the ends of each shielding slat, with which they are connected, said runner units being guided in the respective of the guide rail 3 and displaceable therein by means of an operating device.

The operating device for the vertical displacement of the shielding slats 5 is provided to work directly only on the one shielding slat occupying the undermost position in the shutter device, the runner unit 6 belonging to the same being shown in the FIGS. 5 and 6. The runner units of the shielding slats located above are freely movable in vertical direction between the position in the collecting box 4 and their individual height positions, and they can accordingly be carried along in upwards direction and are permitted to displace themselves downwards respectively when the runner units 6 of the undermost positioned shielding slat is displaced upwards respectively downwards by means of the operating device.

As is evident from FIGS. 6, 8 and 9 the operating device for said movement of vertical displacement comprises a threaded spindle 7, substantially non-displaceable in the longitudinal direction and pivotable mounting in each of the guide rails 3, on which spindle a nut unit 8 is threaded, which is rigidly and non-pivotably mounted in the undermost runner unit 6. The runner units located above are not provided with such nut units 8.

As is evident from FIGS. 5, 6, 8 and 9 the operating device for turning the shielding slats to different positions substantially comprises a bar 9 mounted in at least one of the guide rails 3 and pivotable in its longitudinal direction, said bar exhibiting a non-circular cross-section, in the example of embodiment illustrated, being of square shape, on which bar for each shielding slat 5 a worm screw 10 is journalled in displacement but not pivotable mounting, said screw, however, being pivotably mounted in each one of the runner units 6 located in the guide rail 3 provided with a bar 9. Each worm screw 10 is in mesh with a toothed segment 11, which is pivotably journalled in the respective runner unit 6 together with a pivot 12 extending through the wall of said runner unit, said pivot constituting the pivoting axis of the shielding slat 5 and as is evident from the illustrated example of embodiment, suitably being fitted in assymmetrically displaced mounting relative to the longitudinal edge portion 13 of the shielding slat, which edge portion can be turned inwards and downwards respectively. In certain cases, by way of example in connection with shutter devices with shielding slats of comparatively great length or weight, both the guide rails are provided with the pivoting mechanism described, while in other cases the pivoting mechanism enclosed in the runner unit is left out on the one side of the shielding slat, where the bar 9 is missing, the pivot 12 thus being freely journalled in the runner unit 6 belonging thereto.

In order to retain the shielding slats 5 in their individual positions, the lateral rail 3, as is evident from FIG. 5 is provided with a number of longitudinal grooves 14, in each one of which a stop 28 is mounted with a vertical location determining the individual height position of each of the slats 5. Each runner unit 6 is provided with a projection 15 protruding in sidewise direction from the same, which projection extends into one of the grooves 14, of which each one corresponds to its determined shielding slat. Thus by chosing different positions, which are individual for each shielding slat 5, for on one hand the projections 15 of the runner units 6 and on the other hand the stops of the grooves 14, a lower limit of the freedom of movement of the shielding slats 5 is obtained with an individual height position for each shielding slat 5, in which the shielding slats are supported in their predetermined positions.

As is evident from FIGS. 5 and 7 the shutter device according to the invention is further provided with a number of tightening means in order to secure a complete shielding possibility. For this purpose each one of the guide rails 3 is provided with a longitudinal double tightening ledge 29, which is intended to tighten against the window sash, and a tightening strip 16, which resiliently rests against the end surface of the shielding slat 5. One of the longitudinal edge portions 17 of the slats is provided with two elastic tightening strips 18, which in completely shielded position resiliently rests against the juxtapositioned longitudinal edge portion 13 of the shielding slat positioned nearest below.

As is evident from FIGS. 8 and 9 the operation means in the illustrated example of embodiment comprise transmission means comprising gears 20, 21, 22, 23, which are mounted on each one of the ends of the spindle 7 and the bar 9 respectively in at least one of the guide rails, the mitre gear transmissions 22, 23 located at the top transmitting the pivoting movement of the spindle 7 and the bar 9 respectively to the other guide rail, which in this connection at its top is likewise provided with corresponding conical gear transmissions, whereby a synchronization of the operating movements is obtained. From the conical gear transmissions 20, 21 located at the bottom portion two coaxially arranged shafts 24, 25 extend, which are connected with one of the gears 26, 27 of each one of the conical gear transmissions 20, 21 located in the bottom portion. By means of operating means (not shown) suitably located inside the window, which shall be shielded, an operation of the shielding slat 5 is made possible, thus, for on the one hand a vertical displacement by direct operation of the undermost located shielding slat 5 via the gear transmission 21 and the spindle 7 thereby indirectly lifting and lowering the shielding slat located above the same respectively and on the other hand a pivoting into a desired angular position of the shielding slats 5 by pivoting of the shaft 25 and the bar 9 via the gear transmission 20.

As is evident from the above the shutter device according to the invention lacks cords, bands and similar elements, which are sensitive to wear and influences of the weather. The shutter device instead comprises elements of the type used by the machine building, which can be designed to meet the requirements of great protectional safety and this in addition makes it possible, as already has been mentioned, to place the shutter device outside the windows also under unfavourable climatic conditions, and thereby a possibility is obtained to chose the design of the slats within wide limits without any rigorous considerations to weight and dimensions. Summing up these advantages, viz. the possibilities to permit the positioning of the shutter device outside of windows and glass facades and to be able to provide them with slats of any desired design, they make it possible to design the shutter device with extraordinary properties as regards shielding against cold as well as heat and richly variable possibilities of treatment of the incident light. Especially by making the slats of a glass fibre material, in which the glass fibres extend in a direction at right angle to the principal surfaces of the slats, extraordinary properties in the respect mentioned can be obtained. Also other materials in order to vary the heat insulation and luminous transmittance are available within the range of weight and dimensions permissible for work in connection with the shutter device according to the invention.

We claim:

1. A shutter device for adjustable shielding a surface, including a window surface, which comprises a plurality of shielding slats and operating means for individually and collectively positioning the same over the shielded surface, said slats being pivotable about their longitudinal axes for positioning the same in different predetermined angular positions to provide the desired shielding of said surface, guide rails disposed on each end of said slats, and carrying a plurality of paired runner units each connected to a corresponding slat by means of pivoting shafts so that the slats are pivotable relative the runner units, the guide rails provided with means adapted to retain the slats in individual positions distributed over the shielded surface, said retaining means comprising for each slat first supporting means provided on each runner unit and second supporting means provided in each guide rail, the second supporting means being situated in the transverse direction of its respective guide rail such that each is in the path of movement of the individually placed first supporting means and so situated in the longitudinal direction of the respective guide rail that each slat is in its predetermined individual position when the respective first supporting means is resting on the corresponding second supporting means of the rail, said guide rails being substantially closed units each having a single longitudinal slot for said pivoting shafts and providing box-shaped areas in which the runner units are guided, said areas defined by two opposite short walls, each short wall having a plurality of inwardly extending longitudinal grooves, said first supporting means comprising a plurality of projections on the runner units, at least one said projection being provided for each slat to individually position the same in a predetermined groove in the rails, which groove is provided with a stop for the respective first supporting means situated in the groove to hold the corresponding slat in its predetermined position when the supporting means carried by its corresponding runner unit abuts said stop, said operating means being enclosed by the guide rails and comprising a threaded spindle pivotably mounted in each of the two guide rails, on which spindle each of the runner units is connected for longitudinal displacement, said operating means further comprising a bar pivotably mounted in at least one of the guide rails and operatively connected to worm gears displaceable but not pivotable with respect to said bar, which gears are pivotably carried in respective runner units in the guide rails, and sealing means arranged between the guide rails and the slats and between each slat.

* * * * *